US006099356A

United States Patent [19]

Hwang

[11] Patent Number: 6,099,356

[45] Date of Patent: Aug. 8, 2000

[54] COMPRESSION CONNECTOR

[75] Inventor: Jeng-Yih Hwang, Irvine, Calif.

[73] Assignee: Hon Hai Precision Ind. Co., Ltd., Taipei Hsien, Taiwan

[21] Appl. No.: 09/356,480

[22] Filed: Jul. 19, 1999

[51] Int. Cl.[7] ..... H01R 24/06

[52] U.S. Cl. ..... 439/660; 439/862

[58] Field of Search ..... 439/660, 701, 439/862

[56] References Cited

U.S. PATENT DOCUMENTS

| | | | |
|---|---|---|---|
| 5,556,306 | 9/1996 | Lin et al. | 439/862 |
| 5,599,192 | 2/1997 | Olson | 439/660 |
| 5,980,323 | 11/1999 | Bricaud et al. | 439/862 |
| 6,036,504 | 9/1996 | McHugh et al. | 439/660 |

*Primary Examiner*—Gary F. Paumen
*Attorney, Agent, or Firm*—Wei Te Chung

[57] ABSTRACT

A compression connector includes an insulative housing including a cover and a base. The base includes a bottom plate and a wall formed thereon with spaced passages defined therein. The passages are exposed to a top face of the wall. The cover includes top and bottom panels defining an interior space therebetween for receiving the base. A barb is formed on the bottom plate of the base for engaging with a slot defined in the bottom panel of the cover to retain the base in the cover. The cover defines a plurality of channels in communication with the interior space and corresponding to the passages of the base. A spring contact has a fixing section received in each channel of the cover and a substantially U-shaped contact section resiliently supported in the corresponding passage of the base and biased to partially project beyond the top face of the wall of the base for engaging with a conductive pad of an ink cartridge. A wire extending through an opening defined in a rear wall of the cover is attached to the fixing section of the corresponding spring contact by crimping tabs formed on the spring contact.

2 Claims, 5 Drawing Sheets

COMPRESSION CONNECTOR

BACKGROUND OF THE INVENTION

1. Field of the Invention

The present invention generally relates to a compression connector of a computer printer for controlling ink ejection operations of an ink cartridge.

2. The Prior Art

Computer printers are classified as dot matrix printers, laser printers and ink-jet printers. An ink-jet printer comprises an ink cartridge, usually disposable, for preservation of ink, and an ink jetting head for depositing ink on a medium to be printed. A control circuit connected to the ink cartridge and the ink jetting head controls the printing operation. The connection between parts of the ink jet printer may be provided by a flexible print circuit (FPC) board, a flexible flat cable (FFC) or a wire harness assembly. A connector is required to connect the cable or wires to the ink cartridge or other related components.

A conventional ink cartridge connector comprises an insulative housing defining a plurality of spaced bores for receiving spring-biased contact pins. The pins are contacted and depressed for forming electrical connection when an ink cartridge is inserted. The spring-biased contact pins, however, are complicated in construction and thus are difficult to maintain.

It is thus desired to provide a compression connector for a computer printer that eliminates the problem discussed above.

SUMMARY OF THE INVENTION

Accordingly, an object of the present invention is to provide a compression connector having a simple structure.

Another object of the present invention is to provide a reliable connector for a computer printer.

To achieve the above objects, a compression connector in accordance with the present invention comprises an insulative housing including a base and a cover. The base comprises a bottom plate and a wall formed thereon with spaced passages defined therein. The passages are exposed to a top face of the wall. The cover comprises top and bottom panels defining an interior space therebetween for receiving the base. A barb is formed on the bottom plate of the base for engaging with a slot defined in the bottom panel of the cover to retain the base in the cover. The cover defines a plurality of channels in communication with the interior space and corresponding to the passages of the base. A spring contact has a fixing section received in each channel of the cover and a substantially U-shaped contact section resiliently supported in the corresponding passage of the base and biased to partially project beyond the top face of the wall of the base for engaging with a conductive pad of an ink cartridge. A wire extending through an opening defined in a rear wall of the cover is attached to the fixing section of the corresponding spring contact by crimping tabs formed on the spring contact.

BRIEF DESCRIPTION OF THE DRAWINGS

The present invention will be apparent to those skilled in the art by reading the following description of the preferred embodiment thereof, with reference to the accompanying drawings, in which.

DETAILED DESCRIPTION OF THE PREFERRED EMBODIMENTS

Figure 1:
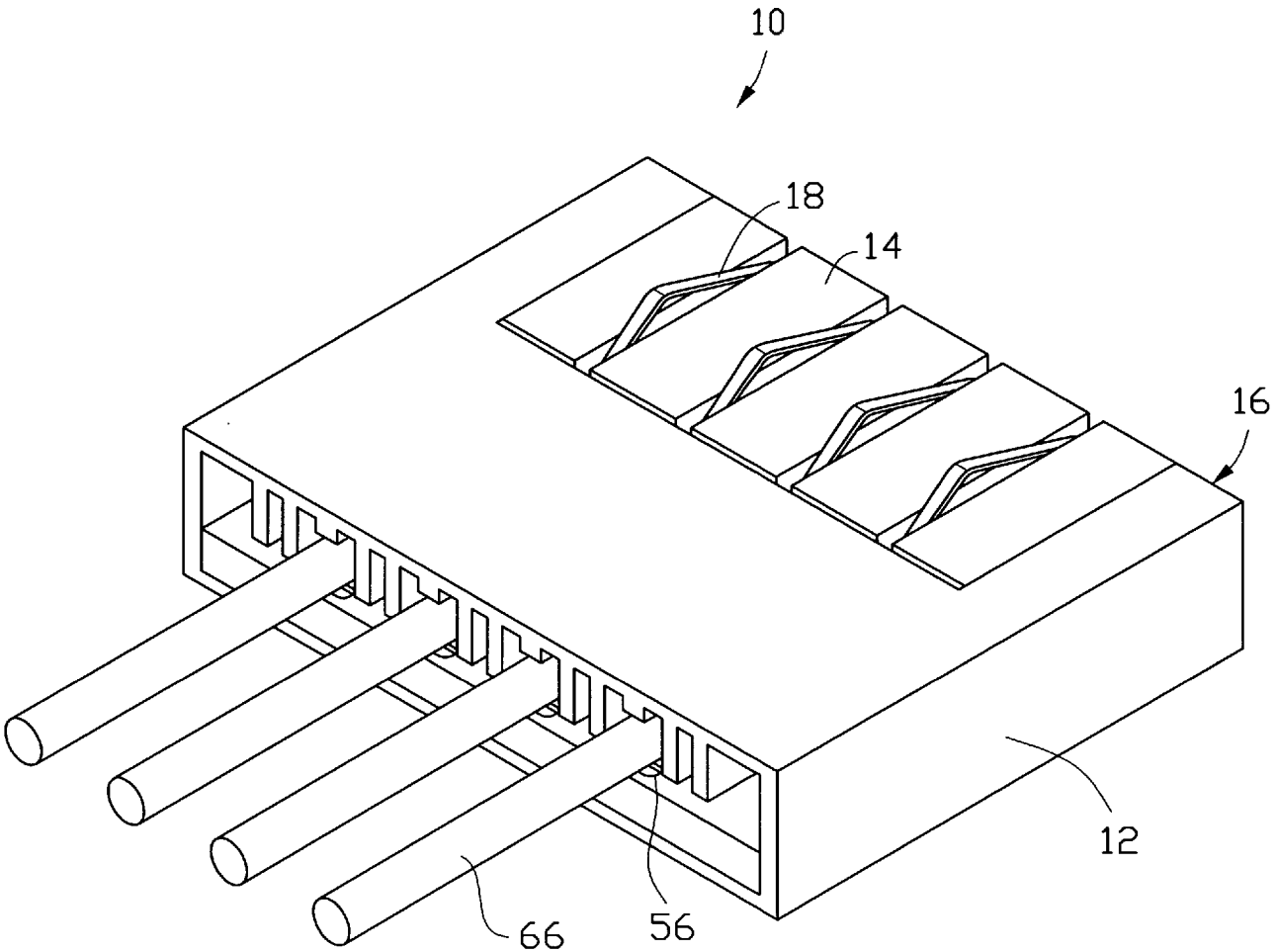
FIG. 1 is a perspective view of a compression connector constructed in accordance with the present invention with a wire harness assembly connected thereto.

Referring to the drawings and in particular to FIG. 1, a compression connector 10 in accordance with the present invention comprises an insulative housing 16 including a cover 12 fixed to a base 14 for retaining a plurality of spring contacts 18 therein with the contacts 18 partially projecting beyond the housing 16 for electrically engaging conductive pads of an external device (not shown), such as an ink cartridge.

Figure 2:
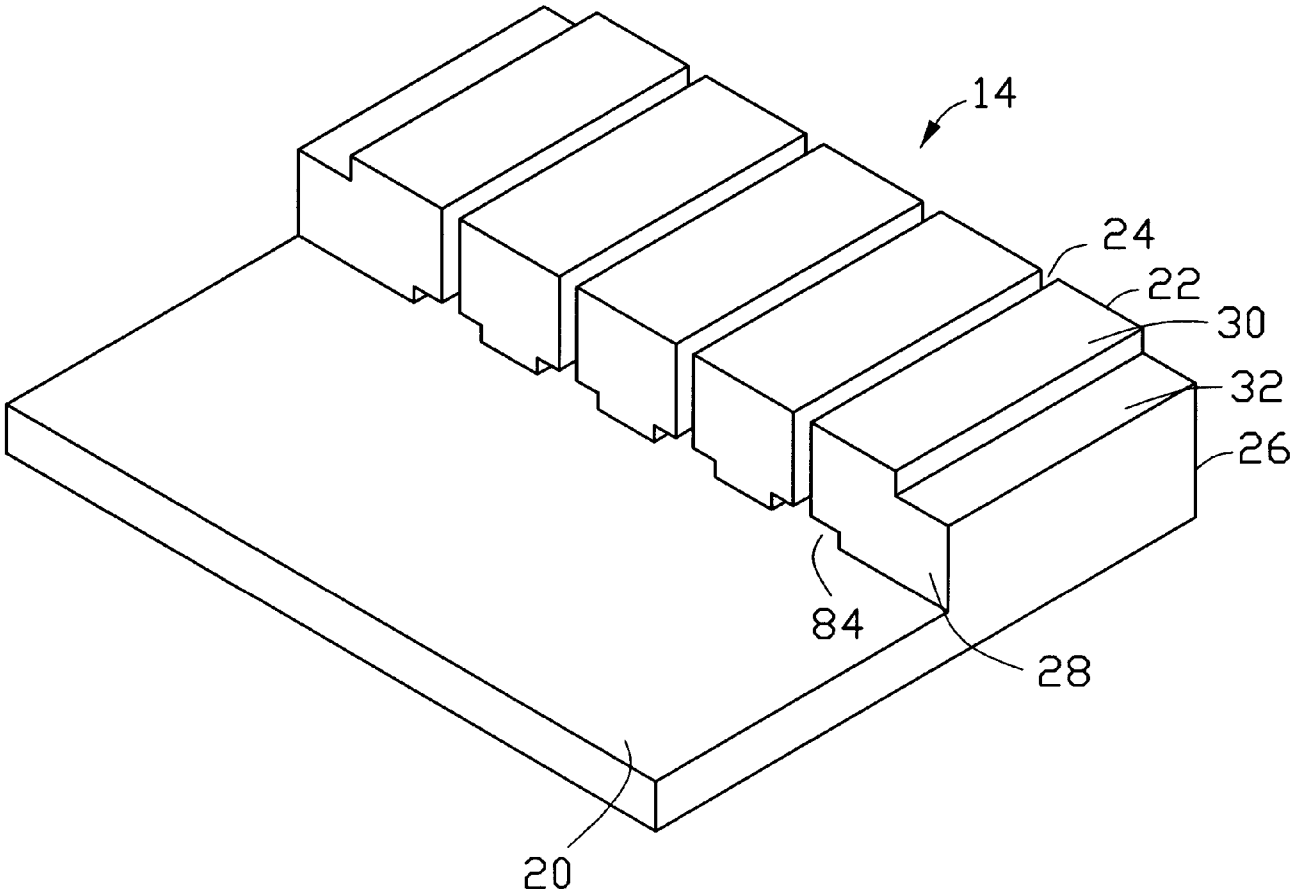
FIG. 2 is a perspective view of a base of an insulative housing of the compression connector.
Figure 3:
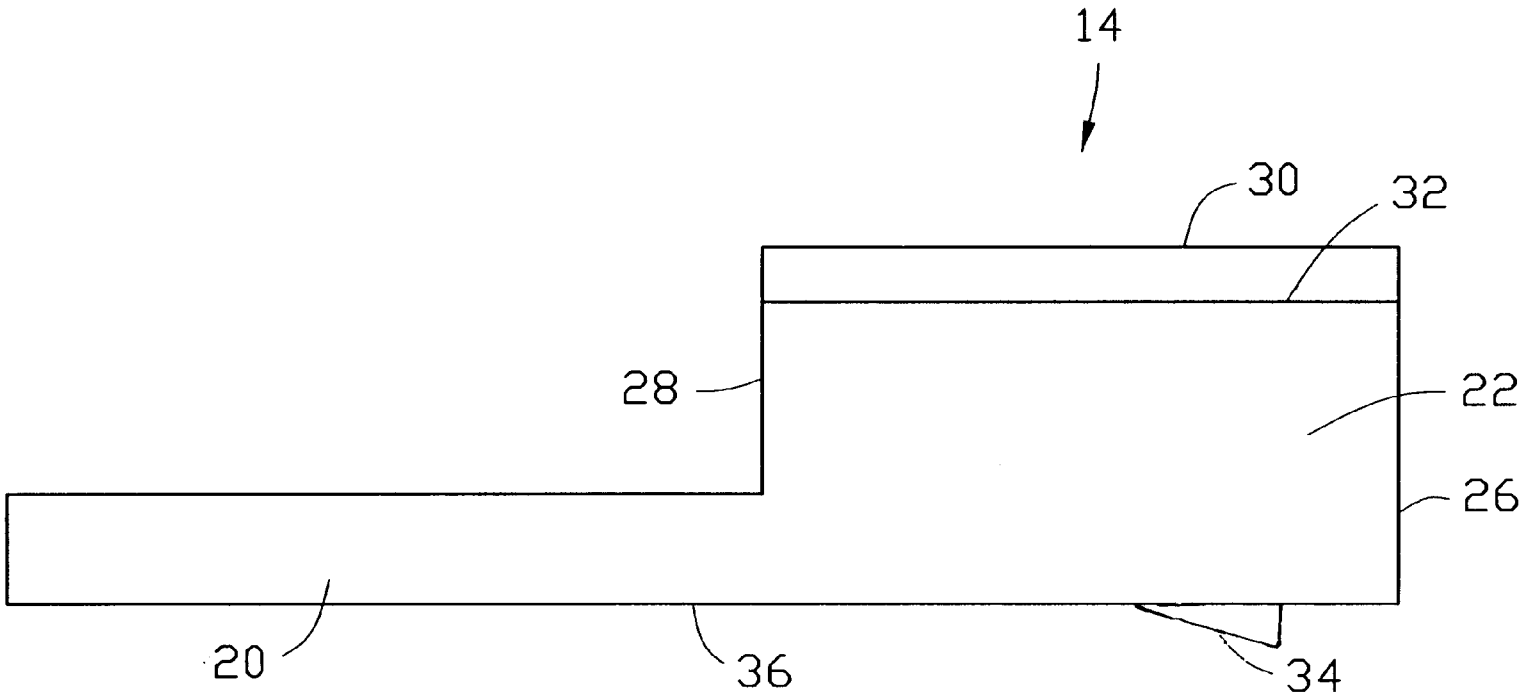
FIG. 3 is a side elevational view of the base of the compression connector.

Also referring to FIGS. 2 and 3, the base 14 comprises a bottom plate 20 on which a wall 22 having front and rear faces 26, 28 is formed. A plurality of spaced passages 24 is defined in the wall 22 and extends between the front and rear faces 26, 28 thereof. Each passage 24 is exposed to a top face 30 of the wall 22. Steps 32 are formed on opposite ends of the wall 22. At least one barb 34 is formed on a bottom face 36 of the base 14.

Figure 4:
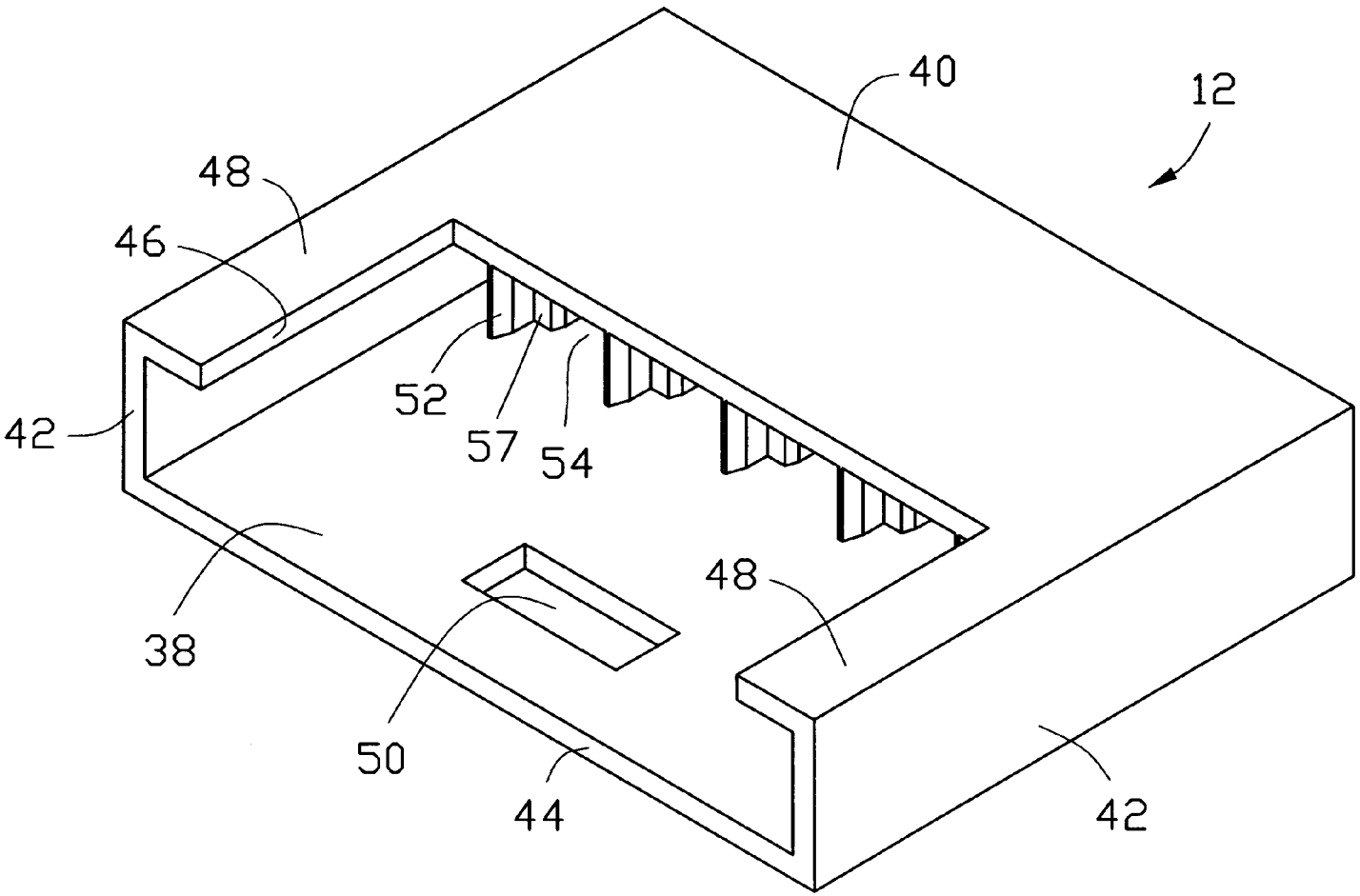
FIG. 4 is a perspective view of a cover of the housing of the compression connector.

Referring to FIG. 4, the cover 12 comprises a bottom panel 38 and a top panel 40 connected by opposite side panels 42 thereby defining an interior space (not labeled) therebetween for receiving the base 14 with the bottom plate 20 of the base 14 supported on the bottom panel 38. The cover 12 has an exposed front end 44 for insertion of the base 14. A cutout 46 is defined in the top panel 40 and forms opposite side flanges 48. The cutout 46 accommodates the wall 22 of the base 14 when the base 14 is inserted into the cover 12, from the front end 44, with the side flanges 48 received in and engaging with the steps 32 of the wall 22 for firmly retaining the base 14 between the top and bottom panels 40, 38 of the cover 12. In this respect, the steps 32 may have a depth corresponding to the thickness of the top panel 40 whereby a smooth, continuous surface is formed when the base 14 is inserted into the cover 12, as shown in FIG. 1. A slot 50 is defined in the bottom panel 38 for snappingly engaging with the barb 34 of the base 14 thereby securely fixing the base 14 in the cover 12. A plurality of partitions 52 is formed in the cover 12 between the top and bottom panels 40, 38 thereby defining a plurality of channels 54 therebetween. Each channel 54 defines an opening 56 (FIG. 1) in a rear wall of the cover 12. Each partition 52 forms a pair of shoulders 57 on opposite sides thereof.

Figure 5:
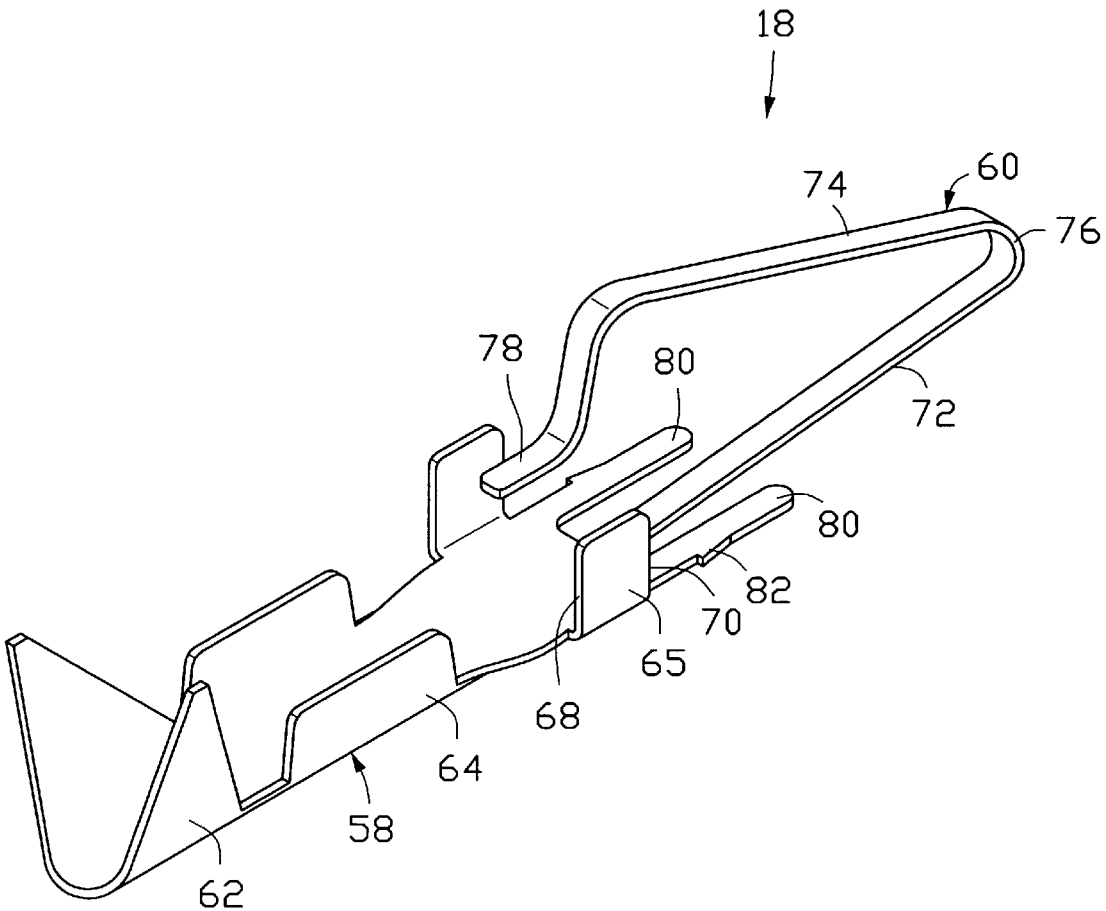
FIG. 5 is a perspective view of a spring contact of the compression connector.

Referring to FIG. 5, each spring contact 18 comprises a fixing section 58 received in the corresponding channel 54 of the cover 12 and a contact section 60 received in the corresponding passage 24 of the base 14. The fixing section 58 comprises two insulative crimping tabs 62 which receive a leading end of a wire 66 (FIG. 1) therebetween and are crimped to engage an insulative coating (not labeled) of the wire 66 for fixing the wire 66 to the spring contact 18. The wire 66 extends beyond the housing 16 through the opening 56. The insulative coating of the leading end of the wire 66 is stripped to expose a conductor (not shown) thereof and the fixing section 58 comprises two conductor crimping tabs 64 for receiving the conductor therebetween. The conductor crimping tabs 64 are crimped to engage with and fix the conductor therebetween.

A pair of retention tabs 65 are formed on opposite edges of the fixing section 58 of each spring contact 18. Each retention tab 65 has first and second edges 68, 70. The first edges 68 of the retention tabs 65 abut against the shoulders 57 of the partitions 52 on opposite sides of the spring contact 18. The second edges 70 of the retention tabs 66 abut against the rear face 28 of the wall 22 of the base 14 when the base 14 is inserted into the cover 12 thereby firmly retaining the spring contact 18 between the base 14 and the cover 12. However, it is apparent that the edges 68, 70 may not need to abut against the shoulders 57 and the wall 22 for the spring contact 18 to be engaged between the base 14 and the cover 12. Furthermore, the retention tabs 65 may be optionally eliminated.

The contact section 60 is received in the corresponding passage 24 of the base 14. The contact section 60 comprises a first beam 72 extending from the fixing section 58 and a second beam 74 connected to the first beam 72 by a U-shaped bent portion 76 whereby the second beam 74 is resiliently supported in the passage 24 and is biased to partially project beyond the top face 30 of the wall 22 for engaging with the corresponding conductive pad of the external device (not shown). Each second beam 74 has an offset free end 78 extending into the cover 12 and engaging with the top panel 40 thereof for being pre-loaded thereby.

Preferably, the first beam 72 extends at an incline toward the top panel 40 for enhancing the resiliency of the spring contact 18. Two extensions 80 of the fixing section 58 are formed on opposite sides of and spaced from the first beam 72. Each extension 80 forms at least one transversely extending retention barb 82. A plurality of recesses 84 is defined in the base 14 in communication with the corresponding passages 24 thereby providing the passage 24 with a T-shaped configuration. The extensions 80 of the spring contact 18 are received in the recesses 84 of the corresponding passage 24 of the base 14 with the barbs 82 interferentially engaging with inside surfaces of the recesses 84 for more securely retaining the spring contact 18 in the passage 24.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A compression connector comprising:

an insulative housing defining a plurality of contact receiving channels each forming an opening in a rear face of the housing and being partially exposed to a top face of the housing; and a spring contact retained in each contact receiving channel of the housing and comprising crimping tabs adapted to retain a leading end of a wire with the wire extending through the corresponding opening of the rear face of the housing, the spring contact comprising a resilient substantially U-shaped contact section biased to partially project beyond the top face of the housing for being adapted to engage with an external conductive member;

wherein the spring contact comprises a base section retained in the contact receiving channel, the contact section comprising a first beam extending from the base section and a second beam connected to the first beam by a U-shaped bent portion whereby the second beam is resiliently supported and partially projects beyond the top face of the housing;

wherein the second beam comprises an offset end engaged with and retained by a top panel of the housing for pre-loading the second beam;

wherein two extensions from the base section are formed on opposite sides of the first beam and are received in recesses defined in inside surfaces of the corresponding contact receiving channel, each extension forming at least one transversely extending barb interferentially engaging with an inside face of the corresponding recess for securely retaining the spring contact in the contact receiving channel;

wherein the housing comprises a base releasably received in a cover;

wherein the cover comprises a bottom panel and a top panel defining an interior space therebetween for receiving the base, the base having a bottom face supported on the bottom panel and a top face engaging the top panel of the cover thereby retaining the base in the cover;

wherein at least one barb is formed on the bottom face of the base for engaging with a notch defined in the bottom panel of the cover to retain the base in the cover;

wherein passages are defined in the base corresponding to the channels for receiving the contact sections of the corresponding spring contacts therein the passage being exposed to the top face of the base for projection of the second beam therethrough;

wherein a cutout is defined in the top panel of the cover and bounded by two side flanges for receiving the base therein, and wherein steps are formed on opposite ends of the base for engaging with and supporting the side flanges.

2. A compression connector comprising:

an insulative housing including:

a base having a bottom plate and a wall formed on the bottom plate, a plurality of spaced passages being defined in the wall between front and rear faces thereof, the passages being exposed to a top face of the wall, and a cover comprising top and bottom panels connected by opposite side panels to define an interior space for receiving the base therein with the bottom plate of the base supported on the bottom panel and the top face of the wall of the base engaging with the top panel, the cover defining a plurality of channels in communication with the interior space thereof and corresponding to the passages of the base; and a spring contact comprising a fixing section received in the corresponding channel of the cover and a substantially U-shaped contact section resiliently supported in the corresponding passage of the base and biased to partially project beyond the top face of the wall of the base for being adapted to engage with an external conductive member;

wherein the contact section of the spring contact comprises a first beam extending from the fixing section and a second beam connected to the first beam by a U-shaped bent portion whereby the second beam is resiliently supported and partially projects beyond the top face of the wall of the base;

wherein the second beam comprises an offset end engaging with and retained by the top panel of the cover for pre-loading the second beam;

wherein two extensions of the fixing section of the spring contact are formed on opposite sides of the first beam, the extensions being received in recesses defined in inside surfaces of the corresponding passage of the base and each forming at least one transversely extending barb for interferentially engaging with an inside face of the corresponding recess to securely retain the spring contact in the housing;

wherein a cutout is defined in the top panel of the cover and bound by opposite side flanges for accommodating the wall of the base, steps being formed on opposite ends of the wall of the base for receiving and supporting the side flanges of the top panel;

wherein the spring contact comprises two retention tabs each having first and second opposite edges, and wherein each channel of the cover has shoulders formed on opposite sides thereof for abutting against the second edges of the retention tabs with the first edges of the retention tabs abutting against the rear face of the wall of the base;

wherein an opening is defined in a rear wall of the cover in communication with the corresponding channel, a wire extending through the opening with a leading end thereof attached to the fixing section of the corresponding spring contact;

wherein the spring contact comprises a pair of space first crimping tabs mounted to the fixing section thereof and adapted to receive and fix a leading end of a wire and a pair of spaced second crimping tabs adapted to receive and fixingly engage a conductor of the wire;

wherein retaining means is formed between the cover and the base for retaining the base in the cover.

* * * * *